US005810570A

United States Patent [19]

Nguyen

[11] Patent Number: 5,810,570

[45] Date of Patent: Sep. 22, 1998

[54] SUPER-LOW NET POSITIVE SUCTION HEAD CRYOGENIC RECIPROCATING PUMP

[75] Inventor: Dan Dinh Nguyen, Houston, Tex.

[73] Assignee: Chemical Seal & Packing, Inc., Houston, Tex.

[21] Appl. No.: 778,952

[22] Filed: Jan. 6, 1997

[51] Int. Cl.[6] ..... F04B 39/08

[52] U.S. Cl. ..... 417/505; 417/901; 277/205

[58] Field of Search ..... 417/505, 901; 277/205

[56] References Cited

U.S. PATENT DOCUMENTS

| | | | |
|---|---|---|---|
| 2,730,957 | 1/1956 | Riede . | |
| 2,837,898 | 6/1958 | Ahlstrand . | |
| 3,016,717 | 1/1962 | Gottzmann . | |
| 3,263,622 | 8/1966 | Tyree, Jr. . | |
| 3,653,670 | 4/1972 | Sifri et al. | 277/205 X |
| 3,680,874 | 8/1972 | Schwarz | 277/205 X |
| 3,847,389 | 11/1974 | Rogers | 277/205 X |
| 4,239,460 | 12/1980 | Gölz | 417/901 X |
| 4,244,192 | 1/1981 | Chellis | 277/205 X |
| 4,388,051 | 6/1983 | Dresler | 417/505 |
| 4,396,362 | 8/1983 | Thompson et al. | 417/439 |
| 4,576,557 | 3/1986 | Pevzner | 417/901 X |
| 4,639,197 | 1/1987 | Tornare et al. | 417/901 X |
| 4,792,289 | 12/1988 | Nieratschker | 417/259 |
| 5,188,519 | 2/1993 | Spulgis | 417/511 |
| 5,511,955 | 4/1996 | Brown et al. | 417/901 X |

FOREIGN PATENT DOCUMENTS

| | | | |
|---|---|---|---|
| 843716 | 6/1970 | Canada | 417/901 |
| 60-75776 | 4/1985 | Japan | 417/901 |

*Primary Examiner*—Charles G. Freay

*Attorney, Agent, or Firm*—Gardere & Wynne, L.L.P.; Theodore F. Shiells; John W. Montgomery

[57] ABSTRACT

A novel reciprocating pump for cryogenic fluids having a super-low NPSH requirement. The pump has a spring-loaded intake valve made of magnetic material and a reciprocating piston having a permanent magnet at its head end. The intake valve is positioned such that when the piston is at or near the top of its stroke, the magnet will tend to pull said intake valve into an open position. The pump also preferably includes a mechanical spring energized (MSE) seal on the upper end of the piston.

2 Claims, 2 Drawing Sheets

SUPER-LOW NET POSITIVE SUCTION HEAD CRYOGENIC RECIPROCATING PUMP

TECHNICAL FIELD

This invention relates generally to cryogenic reciprocating pumps and in particular to a novel cryogenic reciprocating pump having a super-low Net Positive Suction Head requirement.

BACKGROUND OF THE INVENTION

Pumping liquids typically requires maintaining a net suction pressure above the vapor pressure of the liquid being pumped. This is called the Net Positive Suction Head (NPSH) requirement. When the suction pressure becomes too low, cavitation and loss of prime of the pump may result.

Cryogenic liquids, such as liquified natural gas (LNG), are stored at saturated conditions and so the only available NPSH is the static head caused by the level of the liquid in the storage vessel. This NPSH may be very low, particularly when the storage tank is nearly empty. Although, in cryogenics, damages caused by cavitation are less severe than is the case for liquids such as water or oils, loss of prime at low suction head is a particular problem.

Reciprocating pumps are frequently used for pumping cryogenic liquids, such as LNG. However, conventional reciprocating pumps have a difficult time operating under very low NPSH conditions. One problem is inadequate sealing during the suction part of the stroke. Another problem is caused by the spring-loaded suction check valve, which itself introduces a 3–5 psi pressure drop during the suction stroke. Under very low static head conditions with saturated cryogenic liquids, the available suction head may be inadequate to push open a conventional poppet suction valve assembly. Thus, the pump will definitely lose prime at this condition.

Accordingly, there is a need for a reciprocating pump suitable for pumping cryogenic liquids under saturated conditions which has a very low or zero NPSH requirement.

SUMMARY OF THE INVENTION

This need is met in accordance with a preferred embodiment of the present invention wherein a reciprocating pump for cryogenic fluids is provided having a spring-loaded intake valve made of magnetic material and a reciprocating piston having a permanent magnet at its head end, the intake valve being positioned such that when the piston is at or near the top of its stroke, the magnet will tend to pull the intake valve into an open position.

In accordance with a preferred aspect of this invention, the reciprocating pump further has an MSE seal at the upper end of the piston.

BRIEF DESCRIPTION OF THE DRAWINGS

For a more complete understanding of the present invention and the advantages thereof, reference is now made to the following DETAILED DESCRIPTION taken in conjunction with the accompanying drawings in which.

DETAILED DESCRIPTION

Figure 1:
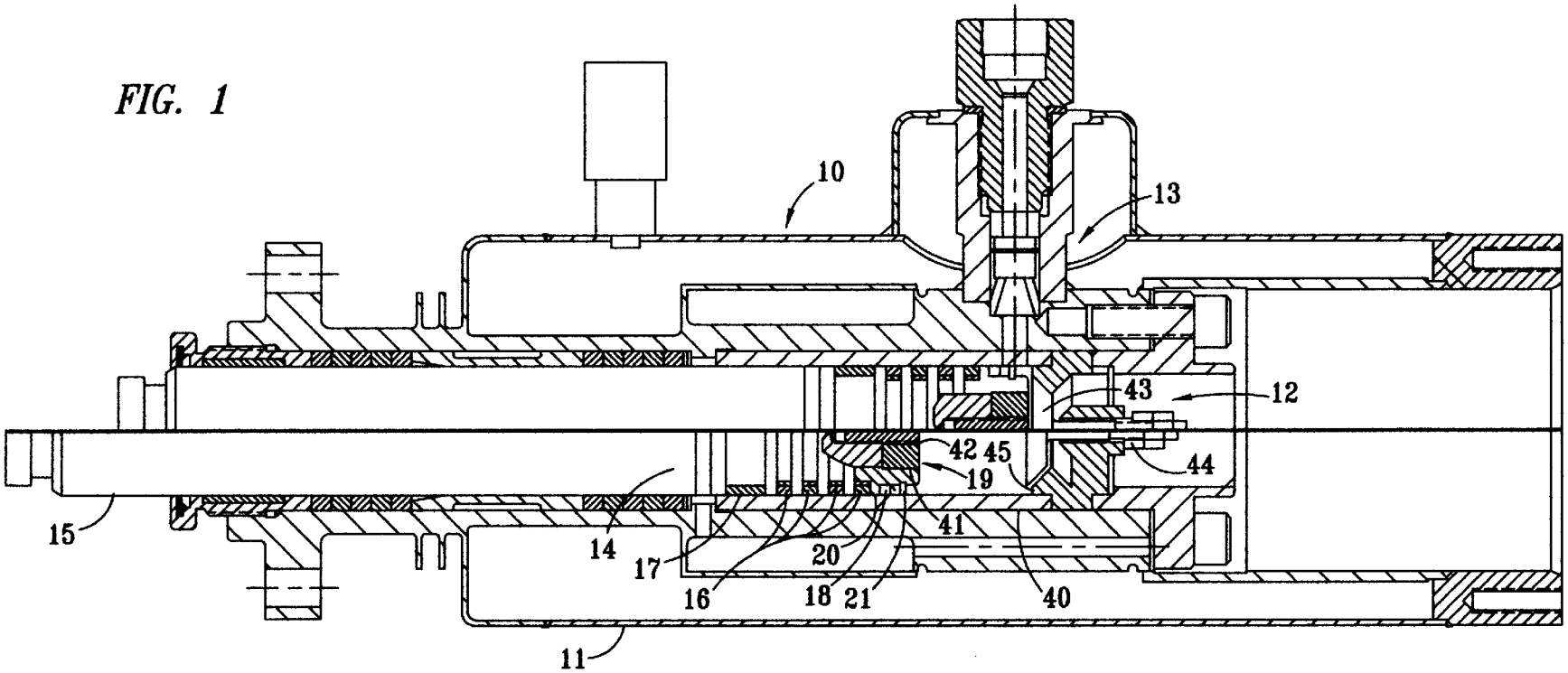
FIG. 1 is a split view of a cross section of the cylinder and inlet and outlet portions of the cryogenic pump of the present invention, the portion of the view above the cylinder centerline depicting the pump with the piston near top dead center and the suction poppet valve closed; the portion of the view below the cylinder centerline depicting the pump with the piston near bottom dead center and the suction poppet valve open.

Referring now to the drawings in detail, wherein like reference characters designate like or similar parts in the figures, a cryogenic pump 10 in accordance with the present invention is depicted. Pump 10 comprises a cylinder housing 11, a spring-loaded poppet suction valve assembly 12, a discharge valve assembly 13, a piston 14, an integral piston rod 15, piston rings 16 with metal expanders, rider rings 17, and a metal spring energized (MSE) seal 18.

The MSE seal 18 is positioned at or near the upper end 19 of the piston 14, supported by a circumferential ledge 20 of piston 14. MSE seal 18 is retained in place at the upper end of piston 14 by a retaining clip 21.

Figure 2:
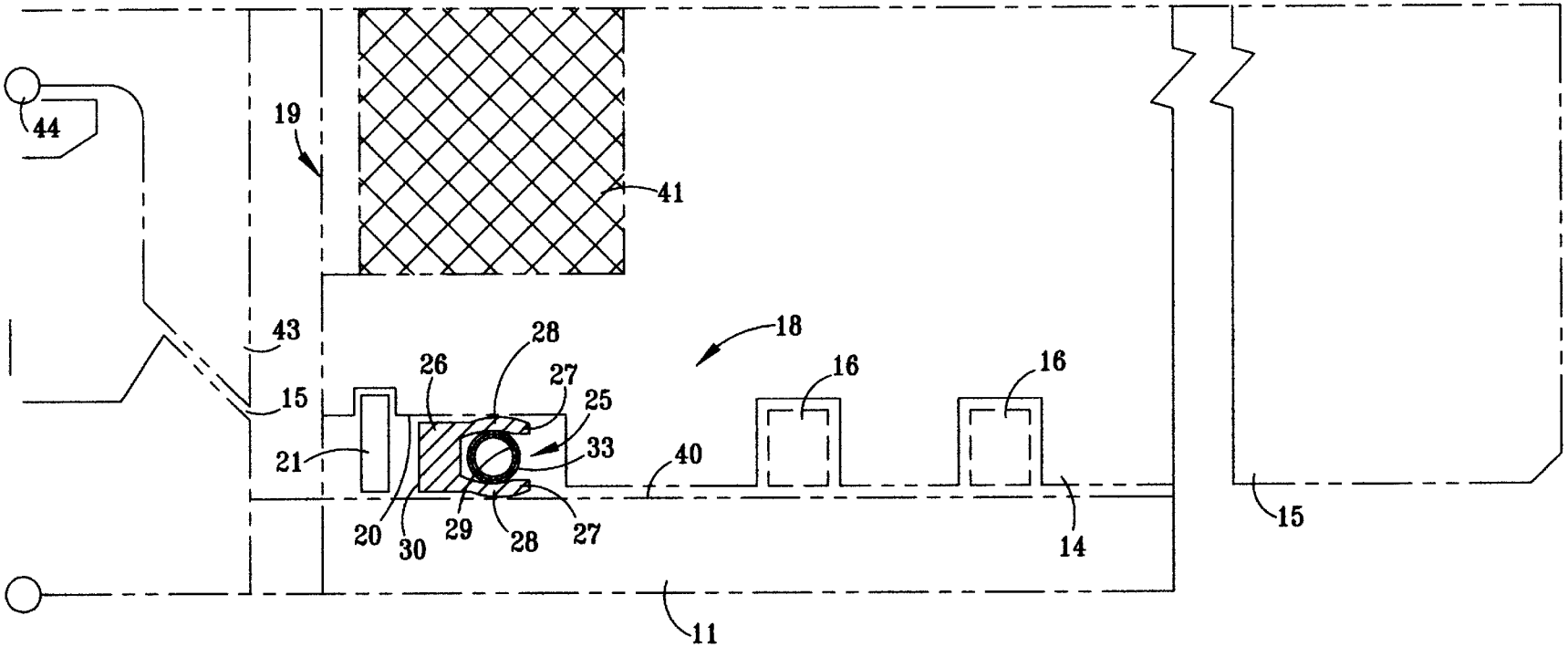
FIG. 2 is an enlarged cross-sectional view of the mechanical spring energized seal (MSE).

Referring now to FIG. 2, MSE seal 18 is depicted in cross-section. MSE seal 18 is comprised of a U-shaped jacket 30 preferably made out of Kel-F brand polychlorotrifluoroethylene, available from 3-M Company, Minnesota, or chlorotrifluoroethylene having similar properties of strength and dimensional stability, and a double spring 25 preferably made out of Elgiloy stainless, a cobalt-nickel alloy having a yield strength of approximately 280 KSI (as used herein KSI shall mean 'thousand pounds per square inch'), available from Elgiloy Company, Elgin, Ind., or other suitable material having similar mechanical properties.

As depicted in FIG. 2, the legs 27 of the "U" are slightly concave on their inner walls, to help retain the double spring 25 in place in between the two legs. The legs 27 are also slightly convex on their outer walls 28 to fit against the outer circumference of piston 14 and to ride against the inner surface of cylinder sleeve 40. The slightly convex outer wall of the leg 27 which is in contact with the inner surface of sleeve 40 helps to provide superior sealing, without excessive wear.

For the size of the exemplary pump described herein, the jacket 30, including the legs 27, preferably has a length in the axial direction of approximately 0.205 inches, a width at the rectangular back end 26 of approximately 0.114 inches and a width at the convex outer walls of approximately 0.136 inches.

The double spring 25 is comprised of an inner and an outer concentric, closely wound helical springs 29 and 33, respectively, preferably made from rectangular Elgiloy wire, or other suitable material, approximately 0.035 inches wide and 0.005 inches thick, wound so that the 0.005 inches dimension is in the radial direction of the spring. The ends of the respective wires are spot welded together to complete the spring.

Double spring 25, as wound, preferably has a length of approximately 5 and ⅛ inch for the size of the exemplary pump described herein. When in place on the piston 14, and installed in sleeve 40, the legs 27 of jacket 30 have a slight interference fit between the piston and the sleeve. This tends to push the legs 27 of the jacket together, squeezing the double spring 25. The double spring, in turn, exerts an outward force, which assists in the superior sealing of the MSE seal 18.

Piston 14 is preferably made out of 17-4 PH stainless, or other suitable material, to give high strength and rigidity. This helps to support the MSE seal 18 and TFE/Bronze (wherein TFE stands for tetrafluroethylene) piston rings 16 against the high discharge pressure. This leads to less deflection and deformation due to the strain of discharge pressure as well as from the enormous change in temperature from assembling the pump in room temperature as compared to the cryogenic working temperature.

The MSE seal 18 is installed on the piston in such a way as primarily to create good vacuum upon the destroking (suction) cycle, i.e., with legs 27 pointing toward the piston rod 15, rather than being positioned primarily to build pressure on the stroking (discharge) cycle like conventional piston rings. The MSE seal 18 thus helps the pump to suck in liquid and not to totally rely on the available NPSH to push in liquid upon the destroking cycle of pumping action. Conventional piston rings with backup metal expanders are not sealed enough to provide strong sucking action like that of the MSE seal 18 due to many leak paths around the piston rings as well as the ring joints. As a result of the novel idea of the MSE seal 18, the required NPSH is reduced.

In accordance with the present invention, the piston also has a permanent magnet 41 embedded at the face 42 of its upper end 19, opposed to suction poppet valve 43. Preferably, the magnet 41 is encapsulated with a non magnetic material such as 304 stainless.

The suction valve 43 is made of magnetic material, such as 17-4 PH or 440 C stainless steel. The purpose of the magnet 41 is to provide a magnetic force to pull open the suction valve 43 at the beginning of destroking (i.e., suction) cycle. At this moment, the piston upper end 19 reaches its top dead center and has its face 42 close to the suction valve 43, within about 0.035". Also at this moment, the trapped discharge pressure falls to about suction pressure. The magnetic force will tend to overcome the force of the spring 44 used to urge the suction valve 43 into a closed position, thus tending to open the suction valve 43. In fact, the suction valve poppet may even momentarily magnetically stick to the magnet 41 at the piston upper end 19. As the suction valve 43 is magnetically pulled away from its seat 45, fresh liquid can easily flow inside the pumping chamber without the pressure loss normally associated with a conventional spring-loaded suction valve. Accordingly, as a result of the novel idea of the magnet, none of the available NPSH is spent to push the suction valve poppet open during the destroking or suction cycle.

The magnetic force is sized in such a way that it will reduce to an insignificant amount before the piston reaches bottom dead center, thus allowing the suction valve 43 to close normally and be reseated by the spring force action before the beginning of the discharge stroke. Accordingly, proper sizing of the magnetic force will maximize the volumetric efficiency of the pump.

A conventional pump requires approximately 5–7 psi of NPSH to keep the pump primed. By contrast, a pump in accordance with the present invention requires less than ¼ psi of NPSH to catch prime. This is an enormous break through in technology of pumping cryogenic liquids at a super low NPSH. In fact, the pump of the present invention can even operate with a slightly negative NPSH, i.e., it can successfully pump a two phase fluid.

The novel ideas of utilizing the MSE seal and/or the permanent magnet to significantly reduce the required NPSH can be applied to any plunger pump for any type of liquid in general but are particularly beneficial for pumping cryogenic liquids.

Although preferred and alternative embodiments of the present invention have been illustrated in the accompanying drawings and described in the foregoing DETAILED DESCRIPTION, it will be understood that the invention is not limited to the embodiments disclosed, but is capable of numerous rearrangements, modifications and substitutions of parts and elements without departing from the spirit of the invention.

What is claimed is:

1. A reciprocating pump for cryogenic fluids, said pump comprising an outlet valve mechanism, a spring-loaded intake valve made of magnetic material, and a reciprocating piston having a permanent magnet at its head; said intake valve being positioned such that when said piston is at or near the top of its stroke, said magnet will tend to pull said intake valve into an open position, and further comprising a mechanical spring-energized seal circumferentially around the upper end of said piston, said mechanical spring-energized seal being arranged primarily to seal in suction, and wherein the mechanical spring energized seal comprises double flat helical metal spring coils with one coil inside of the other.

2. A reciprocating pump for cryogenic fluids, said pump comprising an outlet valve mechanism, a spring-loaded intake valve made of magnetic material, and a reciprocating piston having a permanent magnet at its head end, said intake valve being positioned such that when said piston is at or near the top of its stroke, said magnet will tend to pull said intake valve into an open position, and further comprising a mechanical spring-energized seal circumferentially around the upper end of said piston, said mechanical spring-energized seal being arranged primarily to seal in suction and wherein said mechanical spring-energized seal comprises a chlorotrifluoroethylene jacket having a U-shaped cross-section and having double cobalt nickel alloy spring steel coils positioned in said U-shaped jacket there around for flexibly expanding said jacket at low temperatures.

* * * * *